US006471095B1

(12) United States Patent
Cann

(10) Patent No.: US 6,471,095 B1
(45) Date of Patent: Oct. 29, 2002

(54) DOSING AND DELIVERING SYSTEM

(75) Inventor: David Victor Cann, Surrey (GB)

(73) Assignee: The Proctor & Gamble Company, Cincinnati, OH (US)

( * ) Notice: Subject to any disclaimer, the term of this patent is extended or adjusted under 35 U.S.C. 154(b) by 0 days.

(21) Appl. No.: 09/869,478

(22) PCT Filed: Jan. 12, 2000

(86) PCT No.: PCT/US00/00834

§ 371 (c)(1),
(2), (4) Date: Jun. 28, 2001

(87) PCT Pub. No.: WO00/41816

PCT Pub. Date: Jul. 20, 2000

(30) Foreign Application Priority Data

Jan. 13, 1999 (EP) ..... 99870004

(51) Int. Cl.[7] ..... B67D 5/58

(52) U.S. Cl. ..... 222/190; 222/386; 222/494; 604/311

(58) Field of Search ..... 222/190, 386, 222/494; 604/310, 311

(56) References Cited

U.S. PATENT DOCUMENTS 5,286,257 A * 2/1994 Fischer ..... 604/311
5,499,751 A * 3/1996 Meyer ..... 222/386
5,680,969 A * 10/1997 Gross ..... 222/494
6,234,365 B1 * 5/2001 Bougamont et al. ..... 222/494

* cited by examiner

*Primary Examiner*—Joseph A. Kaufman
(74) *Attorney, Agent, or Firm*—Joan B. Cunningham; Karen F. Clark; Mary Pat McMahon

(57) ABSTRACT

The present invention relates to a dispensing device (1) for a fluid (10), the dispensing device (1) comprising a reservoir (11), a shaft (12), a back seal (13), a damper (14), a piston (151) and a one-way valve (16), the back seal (13) sealing a first end of the reservoir and being displaceable along the shaft, the valve being on the second end of the reservoir, the piston being fixed to one end of the shaft, the piston being located between the valve and the damper, the damper being also fixed to the shaft, the damper being located between the piston and the back seal, whereby the piston has an opened position (151) and a closed position (152), the open position allowing fluid communication between the valve and the pat of the reservoir between the piston and the back seal, the displacement of the piston between the opened and the closed position being induced by a displacement of the shaft along its own axis, the pressure in the area comprised between the valve and the piston reducing when the piston is moved from its closed position towards its opened position, the damper collapsing when the piston is moved from its closed position towards its opened position, the only fluid flow from the part of the reservoir situated between the damper and the back seal and the part of the reservoir situated on the other side of the damper being a connecting passage (140) situated in the damper (14) when the piston is moved from its opened position towards its closed position.

7 Claims, 1 Drawing Sheet

DOSING AND DELIVERING SYSTEM

TECHNICAL FIELD

The invention relates to a mechanical assembly for dosing and delivering a fluid.

BACKGROUND OF THE INVENTION

Devices for dosing and delivering a fluid are widely used in consumer goods or in pharmaceutical industry. Such devices for dosing and delivering a fluid should allow a good control of the quantity of fluid dosed, as well as a good control of the delivery of this fluid dose. In particular in the pharmaceutical industry, accurate control of both the quantity and the delivery are critical. Furthermore, it is desired to produce such devices in a reproducible and economical manner. It is the object of this invention to provide accurate dosing and delivery of a fluid by means of an economical dosing and delivery device.

In accordance with the invention, this object is accomplished in a dispensing device for a fluid, the dispensing device comprising a reservoir, a shaft, a back seal, a damper, a piston and a one-way valve, the back seal sealing a first end of the reservoir and being displaceable along the shaft, the valve being on the second end of the reservoir, the piston being fixed to one end of the shaft, the piston being located between the valve and the damper, the damper being also fixed to the shaft, the damper being located between the piston and the back seal, whereby the piston has an opened position and a closed position, the open position allowing fluid communication between the valve and the part of the reservoir between the piston and the back seal, the displacement of the piston between the opened and the closed position being induced by a displacement of the shaft along its own axis, the pressure in the area comprised between the valve and the piston reducing when the piston is moved from its closed position towards its opened position, the damper collapsing when the piston is moved from its closed position towards its opened position, the only fluid flow from the part of the reservoir situated between the damper and the back seal and the part of the reservoir situated on the other side of the damper being a connecting passage situated in the damper when the piston is moved from its opened position towards its closed position.

A device formed in accordance to the invention has a number of advantages. Since the devices comprises a piston having an opened position and a closed position allowing fluid communication between the valve and the reservoir, the quantity of fluid to dispense can be accurately controlled by displacing the desired quantity of fluid from the reservoir to the valve part by displacement of the piston from the closed to the opened position, the absence of a direct link between the reservoir and the valve avoiding uncontrolled emptying of the reservoir through the valve. Further, as the pressure in the area comprised between the valve and the piston reduces when the piston is moved from its closed position towards its opened position, the displacement of the piston towards the opened position will necessitate the application of a force threshold sufficient to overcome or at least to balance the pressure reduction and internal system friction forces, so that undesired displacement of the piston is avoided. The delivery of the dose is also accurately controlled via the combination of the use of the one way valve, of the piston, of the damper and of the back seal. Indeed, the one way valve will allow delivery of the fluid only when the piston is displaced forward towards the valve, the speed of displacement of the piston being regulated by the size of the connecting passage provided in the damper combined with the fluid viscosity and applied mechanism force (e.g. spring force), thus allowing control on the speed of the fluid delivery through the valve.

DETAILED DESCRIPTION OF THE INVENTION

The invention will now be described with reference to the accompanying drawings in which.

Figure 2:
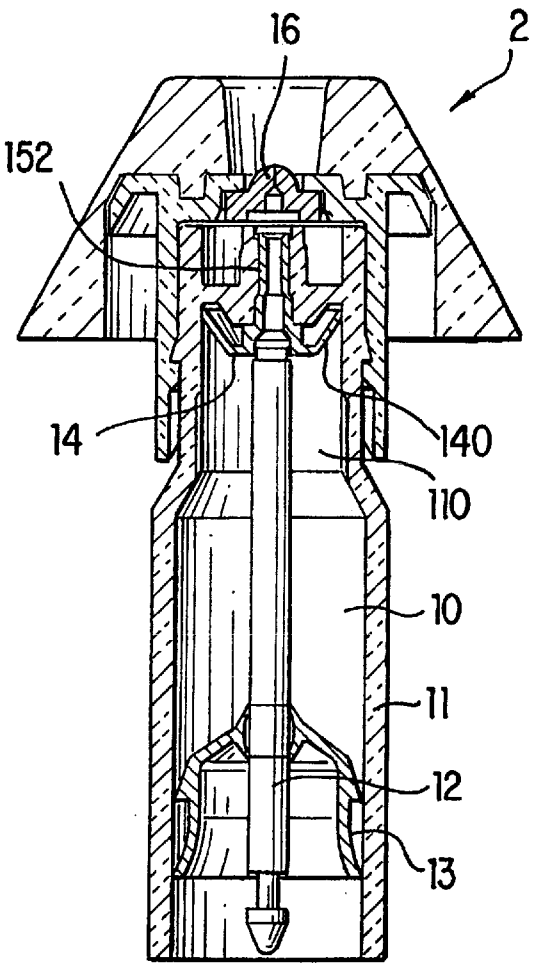
FIG. 2 is a plan cross section view illustrating a dispensing device in accordance with the invention, the piston being in closed position.
Figure 1:
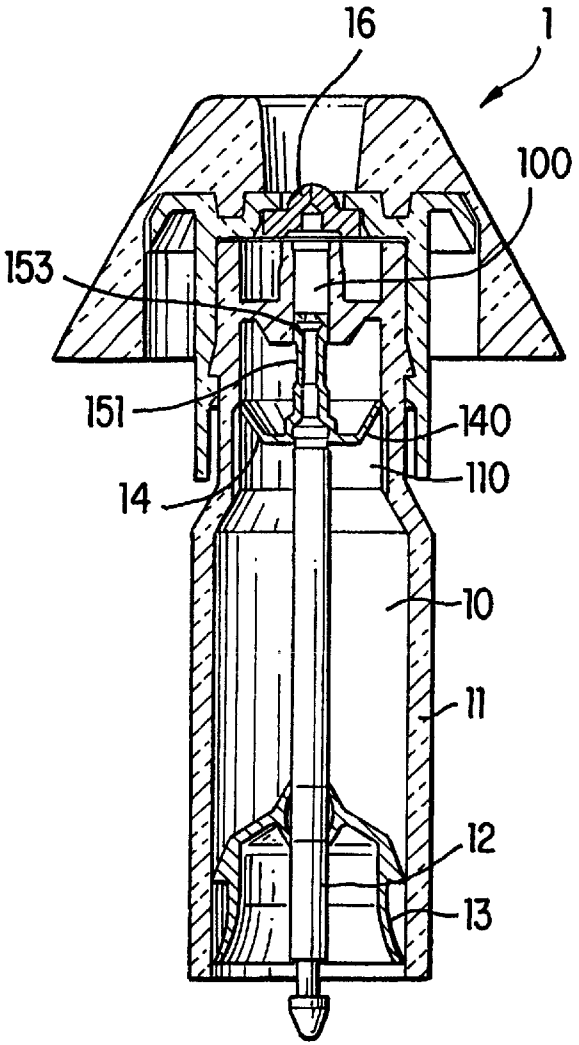
FIG. 1 is a plan cross section view illustrating a dispensing device in accordance with the invention, the piston being in opened position.

The invention relates to a dispensing device 1 or 2 for a fluid 10. By fluid it should be understood that it includes liquids having various viscosities. Preferred fluids in a preferred embodiment of the invention are pharmaceutical fluids, but other applications are envisaged, such as air-freshening devices for example. The dispensing device 1 or 2 comprising a reservoir 11. The reservoir is typically a chamber in which the fluid 10 is to be found. In a preferred embodiment, the reservoir is substantially gas tight, thus avoiding or limiting chemical evolution due to contact with $O_2$ or $H_2O$ vapour for example, or to retain air out of the device, in order to avoid discrepancies in the quantity of fluid to dose.

The dispensing device further. comprises a shaft 12, the shaft typically being an elongated element having as a main axis the more elongated direction, the shaft also normally comprising a part having a constant cross section in a plane normal to the main axis for allowing translation of a back seal 13, or being for example threaded to allow helical displacement of the a back seal 13 along the shaft 12.

The device further comprises a back seal 13, the back seal 13 allowing sealing of the reservoir 11, substantially independently from the quantity of fluid 10 contained in the reservoir 11. This can be obtained for example by having a main part of the reservoir 11 having a constant cross section in a plane perpendicular to the main axis of the shaft 12, the back seal 13 having a substantially identical cross section, the back seal 13 cross section being preferably marginally larger than the constant cross section of the reservoir 11 in order to achieve sealing, so that displacement of the back seal 13 along the shaft 12 allows to seal the reservoir 11 along the constant cross section at any level in the main part of the reservoir 11 having the constant cross section, thus allowing to seal in a gas tight manner a varying volume. In a preferred embodiment, the back seal 13 is made of a flexible and resilient material having an umbrella like shape, or even more preferably a double umbrella like shape, such that the seal is constantly pressing against the reservoir 11 on the cross section perimeter.

The device 1 or 2 further comprises a damper 14. The damper is preferably a part made of a flexible material and having a umbrella like shape favouring collapsing during displacement in one direction and damping during displacement in the other direction.

A piston 151 or 152 is also included in the device of the invention. The piston 151 or 152 is typically a part having a constant cross section being in a plane perpendicular to its main axis, this piston 151 or 152 being elongated along the main axis, the piston 151 or 152 being displaced in a part of the reservoir 11 which has a cross section in a plane normal to the main axis of the piston 151 or. 152 which is substantially equal but preferably marginally smaller to the one of the piston 151 or 152 in order to allow good sealing. Normally, the main axis of the piston 151 or 152 is parallel of even aligned with the main axis of the shaft 12. The device further comprises a one-way valve 16. By a one way valve it should be understood that in normal use, the valve 16 will allow passage of the fluid in one direction only. In a preferred embodiment, the valve 16 is a"self-seal" valve as described for example in principle in EP-A-0 597 601, EP-A-0 395 380 or EP-A-0 160 336.

A necessary feature of the device of the invention is that the back seal 13 is sealing a first end of the reservoir 11. This allows to use a gas tight reservoir 11, which is useful to allow stability of the fluid product 10 and is necessary to the functioning of the device as will be described below.

The back seal 13 should also be displaceable along the shaft 12, such displacement including linear or helical displacement for example.

The valve 16 is on the second end of the reservoir 11. Indeed, the reservoir is normally elongated along the main direction of the shaft, and comprises two ends only, the first one being sealed by the back seal 13 and the other comprising the valve 16.

The piston 151 or 152 is fixed to one end of the shaft 12. Indeed, the piston 151 or 152 is used in the device 1 or 2 according to the invention to push a dose 100 of product towards the valve 16. In order to achieve this, the piston 151 or 152 is located between the valve 16 and the damper 14.

The damper 14 is also fixed to the shaft 12, the damper 14 being located between the piston 151 or 152 and the back seal 13. Indeed, the damper 14 is located in the part 110 of the reservoir 11 which is not containing a dose 100 ready to be dispensed. Indeed, the device 1 or 2 according to the invention is mainly intended for multiple use, so that the damper 14 stands in the part of the reservoir 11 which contains a plurality of doses which are not ready to be dispensed as they are not located between the piston and the valve. It should be noted that the device 1 or 2 could also be suitable for single use.

In order for the device of the invention to be functional, the piston 151 or 152 has an opened position 151 and a closed position 152, the open position 151 allowing fluid communication 153 between the valve 16 and the part of the reservoir 11 between the piston 151 and the back seal 13. This fluid communication 153 allows a dose of product 100 to be placed in between the piston 151 and the valve 16 prior to dispensing.

The displacement of the piston between the opened 151 and the closed 152 position is induced by a displacement of the shaft 12 along its own axis, which is the main axis. The pressure in the area 100 comprised between the valve 16 and the piston reduces when the piston is moved from its closed position 152 towards its opened position 151, thus generating a part vacuum. This allows to "suck in" a dose 100 of product from the part of the reservoir 11 located between the piston an the back seal into the part 100 between the valve and the piston when the piston goes in opened position 151.

The damper 14 collapses when the piston is moved from its closed position 152 towards its opened position 151. This allows easing of the preparation for dispensing and avoids excessive opposite forces when the operator actuates the device, whereby movement or displacement of the piston from its closed position towards its opened position will prepare for opening the fluid communication 153 between the part of the reservoir between the piston and the back seal and the part 100 between the valve and the piston, in order to fill this last part with fluid by means of the pressure reduction or part vacuum mentioned above, the dose of fluid 100 being "sucked in" this part by the pressure reduction through the fluid communication 153 being ready to be dispensed when pushed by the piston through the valve.

As the only fluid flow from the part of the reservoir situated between the damper and the back seal and the part of the reservoir situated on the other side of the damper is a connecting passage 140 situated in the damper 14 when the piston is moved from its opened position towards its closed position, such a move leading to delivery of the fluid ready to be delivered is damped by the limitation on the fluid flow in the connecting passage 140 situated in the damper 14. Indeed, for delivery of the dose 100 situated between the piston and the valve 16, the piston has to move from Its opened 151 towards its closed 152 position, thus moving the damper 14 as both the damper 14 and the piston are fixed to the shaft 12, the damper 14 moving through the fluid 10, thus creating a non-equilibrium in the sealed reservoir 11 between the part of the reservoir located between the damper 14 and the back seal 13 and the part of the reservoir 11 located between the damper 14 and the piston, this non-equilibrium being compensated by a flow in the connecting passage 140 situated in the damper 14, thus controlling the speed of ejection or delivery of the dose 100 ready to be dispensed through the valve 16 by control of the move of the piston. Indeed, the piston will have a maximum speed depending marginally on the compressibility and mainly on the viscosity of the fluid and on the geometrical and/or mechanical characteristics of the device. Indeed, for example, the larger the connecting passage 140 or the higher the applied forward force to the shaft 12 the higher the maximum speed.

In a preferred embodiment, the shaft is made out of a material conducting electricity, such as metal for example. Indeed, in a more preferred embodiment, the fluid is electrically charged prior to being dispensed. The device according to the invention is particularly suited for this application as charging of the fluid will be facilitated by the control on the flow. In particular, there is a maximum speed beyond which charging the fluid becomes difficult or impossible, so that a damped delivery allows good charging. Preferably, the charge rate is matched to the fluid flow rate to achieve efficient electro-hydrodynamic atomisation of the fluid.

In a preferred embodiment, the volume comprised between the piston in the opened position and the valve is of less than 100 $\mu$L.

In another preferred embodiment, the control on delivery is such that the volume of fluid dispensed at each dispensing operation varies of less than 10% between each dispensing operation. Even more preferably, the variation is of less than 5%.

In a further preferred embodiment, a compressed spring is located on the end of the shaft opposite to the one to which the piston is fixed, applying a force onto the shaft in a direction substantially parallel to the shaft axis.

In an additional preferred embodiment, the connecting passage is a single opening provided in the damper, even more preferably a circular opening.

A most preferred embodiment of the invention is obtained by integrating the device of the invention to the spray device as disclosed in the pending applications GB9806937.0 and GB9806939.6.

Such a spray device is particularly suited for treatment of maladies affecting the nasal region, such as hay fever or congestion due to colds. Recently it has been recognised that the mucous membranes of the nasal cavity can be used as a convenient delivery site for drugs targeted at other areas of the body. See for example WO 92/11049 which discloses a pen shaped device for nasal administration of, particularly, insulin. A spray form is often convenient for such treatments. Treatment of the eyes can also conveniently be effected by a spray device. Preferred volume doses for such applications are generally low, down to less than 10 $\mu$l. Typically, repeat dosing will be required in order to make a treatment fully effective. Achieving clean stop-start flow from spray devices delivering such low volumes can be difficult. Typical problems encountered include residual weeping from a valve after application, with the potential for back contamination, and valve clogging.

Use of an elastomeric valve, particularly a slit valve, provides clean stop-start flow without clogging, particularly by the combination of the valve (clean start) and sudden pressure reduction via pressure relief area (clean stop), even if the sprayed fluid comprises a finely divided particulate solid.

Preferably, the spray device is adapted to provide one or more unit doses of a fluid, each dose having a volume in the range from about 1 to about 100 $\mu$l, the device comprising an elastomeric, self-sealing valve having a fluid side and a delivery side, the valve opening to allow passage of the fluid when pressure is applied to fluid on the fluid side and sealing when the pressure is removed.

Preferably the spray device is an electrostatic spray device which charges the spray before entry into the nostrils.

Fluids

The device of the invention preferably comprises a fluid reservoir containing a pharmaceutically acceptable fluid, the fluid comprising a pharmaceutically acceptable treatment agent selected from medicaments, flavours, salts, surfactants and mixtures thereof. The fluid optionally comprises other adjuvants dissolved or dispersed within it. The fluid can be aqueous or non-aqueous. Suitable aqueous fluids include water and mixtures of water with water-miscible solvents such as glycerol, propylene glycol, or alcohols such as ethanol or isopropyl alcohol. Aqueous emulsions can also be used, either water-in-oil or oil-in water emulsions. Preferably the fluid is an aqueous solution, dispersion or oil-in-water emulsion. Suitable non-aqueous fluids comprise polyethylene glycols, glycerol, propylene glycol, dimethyl isosorbide, silicone oils, ketones, ethers and mixtures thereof.

Although not limited to any particular range of resistivity, the invention has particular application to low resistivity fluids, especially those having a bulk resistivity of less than $1\times10^8$ ohm.cm, preferably those having a resistivity of less than $1\times10^4$ ohm.cm, more preferably less than $1\times10^3$ ohm.cm. If necessary, the fluid may comprise a resistivity modifier, such as a pharmaceutically acceptable salt, in order to bring the bulk resistivity within the required range.

The fluid is preferably a pharmaceutically acceptable intranasal carrier. Preferably, the nasal composition is isotonic, i.e., it has the same osmotic pressure as blood and lacrimal fluid. The desired isotonicity of the compositions of this invention may be accomplished using, for example, the sodium chloride already present, or other pharmaceutically-acceptable agents such as dextrose, boric acid, citric acid, sodium tartrate, sodium citrate, sodium phosphate, potassium phosphate, propylene glycol or other inorganic or organic solutes. Sodium chloride is preferred particularly for buffers containing sodium ions. Further examples of sodium chloride equivalents are disclosed in *Remington's Pharmaceutical Sciences* pp. 1491–1497 (Alfonso Gennaro 18th ed. 1990), which is herein incorporated by reference.

Medicaments

The fluid can comprise a wide range of medicaments. By "medicament" is meant a drug or other substance intended to have a therapeutic effect on the body. Suitable levels of the medicament are from 0.001 to 20%, preferably from 0.01 to 5%, more preferably from 0.1 to 5%. It will be appreciated that the levels of specific medicaments will depend on many factors including their potency, safety profile, solubility / ease of dispersion and intended effect. The medicament, when used, can be one which is intended to have an effect at the site of application, such as a decongestant, antihistamine or anti-inflammatory drug, or it may be intended for systemic absorption such as an anti-viral, anti-depressant, anti-emetic, anti-pyretic medicament or a hormone or suchlike. The medicament can be soluble in the fluid or can be an insoluble, finely divided particulate liquid or solid dispersed within the fluid.

Suitable decongestants include oxymetazoline, tramazoline, xylometazoline, naphazoline, tetrahydrazoline, pseudoephedrine, ephedrine, phenylephrine, their pharmaceutically acceptable salts, such as the hydrochlorides, and mixtures thereof. Preferred decongestants are selected from oxymetazoline, xylometazoline, their pharmaceutically acceptable salts and mixtures thereof. Especially preferred for use herein is oxymetazoline hydrochloride which is soluble in water. When used in the compositions of the present invention, the decongestant is preferably present at a concentration of from about 0.01% to about 3.0%, more preferably from about 0.01% to about 1%.

Antihistamines useful to the present invention include, but are not limited to, fast-acting, histamine H-1 receptor antagonists. Such H-1 receptor antihistamines may be selected from among the following groups of antihistamines: alkylamines, ethanolamines, ethylenediamines, piperazines, phenothiazines, piperidines. Examples of useful fast acting antihistamines include acrivastine, carbinoxamine, diphenhydramine, chloropheniramine, brompheniramine, dexchloropheniramine, doxylamine, clemastine, promethazine, trimeprazine, methdilazine, hydroxyzine, pyrilamine, tripelennamine, meclizine, triprolidine, azatadine, cyproheptadine, rocastine, phenindamine or pharmaceutically acceptable salts and mixtures thereof. Other useful antihistamines include terfenadine, azelastine, cetirizine, astemizole, ebastine, ketotifen, lodoxamide, loratadine, levocabastine, mequitazine, oxatomide, setastine, tazifylline, temelastine or pharmaceutically acceptable salts and mixtures thereof. When used in the compositions of the present invention, the antihistamine component is preferably present at a concentration of from about 0.01% to about 3.0%, more preferably from about 0.01% to about 1%.

The medicament can also be an anti-inflammatory agent such as a corticosteroid. Particularly preferred agents within this class are glucocorticoids selected from the group consisting of beclo-methasone, flunisolide, fluticasone, memetasone, budesonide, pharmaceutically acceptable salts thereof and mixtures thereof. When used in the compositions of the present invention, the anti-inflammatory agent is preferably present at a concentration of from about 0.001% to about 0.1%, more preferably from about 0.01% to about 0.1%.

Also useful herein are xanthine derivatives such as caffeine and methylxanthine and the like; antiallergics; mucolytics; anti-cholinergics; non-opiate analgesics such as acetaminophen, acetylsalicylic acid, ibuprofen, etodolac, fenbuprofen, fenoprofen, ketorolac, flurbiprofen, indomethacin, ketoprofen, naproxen, pharmaceutically acceptable salts thereof and mixtures thereof; opiate analgesics such as butorphanol; leukotriene receptor antagonists; mast cell stabilisers such as cromolyn sodium, nedocromil and lodoxamide; lipoxygenase inhibiting compounds; and nicotin, insulin and calcinotin.

Further examples of suitable medicaments can be found in WO97/46243, EP-A-780127, U.S. Pat. Nos. 5,124,315, 5,622,724, 5,656,255 and 5,705,490.

Flavours

Various flavouring and/or aromatic components (e.g., aldehydes and esters) can be used in the fluids of. the invention. These include, for example, menthol, camphor, eucalyptol, benzaldehyde (cherry, almond); citral (lemon, lime); neral; decanal (orange, lemon); aldehyde C-8, aldehyde C-9 and aldehyde C-12 (citrus fruits); tolyl aldehyde (cherry, almond); 2,6-dimethyl-octanal (green fruit); 2-dodecenal (citrus, mandarin); and herbal components such as thyme, rosemary and sage oils. Additional aromatic components suitable for use in the present invention include those described in U.S. Pat. No. 4,136,163 to Watson et al., U.S. Pat. No. 4,459,425 to Amano et al., and U.S. Pat. No. 4,230,688 to Rowsell et al.; all of which are herein incorporated by reference. Mixtures of these aromatics can also be used.

Surfactants

The fluid can also comprise one or more pharmaceutically acceptable surfactants. Such surfactants can be useful for dispersing or emulsifying medicaments or flavours, for enhancing absorption across the nasal membrane or as treatment agents in their own right, such as for softening earwax. The surfactants can be anionic, nonionic, cationic or amphoteric, preferably they are nonionic. Typical nonionic surfactants useful herein include: polyoxyethylene derivatives of fatty acid partial esters of sorbitol anhydrides such as polysorbate 80; polyoxyethylene derivatives of fatty acids such as polyoxyethylene 50 stearate, as well as oxyethylated tertiary octyl phenol formaldehyde polymer (available from Sterling Organics as Tyloxapol) or mixtures thereof. The usual concentration is from 0.1% to 3% by weight.

Salts

The fluid can also comprise one or more pharmaceutically acceptable salts. The salt can mineral salts such as e.g. sodium chloride, or salts of organic acids such as sodium citrate.

Other Adjuvants

The fluid can further comprise other ingredients such as thickeners, humectants, suspending aids, encapsulating aids, chelating agents and preservatives.

The viscosity of the compositions may be maintained at a selected level using a pharmaceutically-acceptable thickening agent. Suitable thickening agents include, for example, xanthan gum, methyl cellulose, microcrystalline cellulose, carboxymethyl cellulose, chitosan, hydroxypropyl cellulose, hydroxypropyl methyl cellulose, hydroxymethyl cellulose, hydroxyethyl cellulose, carboxyvinyl polymer, carbomer, and the like or pharmaceutically acceptable salts thereof. Mixtures of such thickening agents may also be used. The preferred concentration of the thickener will depend upon the agent selected. The important point is to use an amount which will achieve the selected viscosity. Viscous compositions are normally prepared from solutions by the addition of such thickening agents.

Fluids useful in the present invention can also comprise from about 0.01% to about 5% of a humectant to inhibit drying of the mucous membrane and to prevent irritation. Any of a variety of pharmaceutically-acceptable humectants can be employed including, for example sorbitol, propylene glycol, polyethylene glycol, glycerol or mixtures thereof. As with the thickeners, the concentration will vary with the selected agent, although the presence or absence of these agents, or their concentration is not an essential feature of the invention.

A pharmaceutically-acceptable preservative is generally employed to increase the shelf life of the compositions of the present invention. A variety of preservatives including, for example, benzyl alcohol, parabens, phenylethyl alcohol, thimerosal, chlorobutanol, chlorhexidine gluconate, or benzalkonium chloride can be employed. The most preferred preservative system for use herein comprises a combination of benzalkonium chloride, chlorhexidine gluconate and disodium EDTA as a chelating agent. A suitable concentration of the preservative will be from 0.001% to 2% based on the total weight, although there may be appreciable variation depending upon the agent selected.

The device is adapted to provide one or more unit fluid doses, preferably multiple fluid doses, each preferably with a volume in the range of from about 1 to about 100 $\mu$l, more preferably from about 1 to about 20, more preferably from about 5 to about 15 $\mu$l. The dose volume is preferably pre-set but may be adjusted by the user to a desired volume. Preferably, the device is a refill unit which may be part of a larger device and which may be changed or replaced.

The device is preferably adapted to produce a spray having a fluid ligament, the ligament extending from the nosepiece and having a nosepiece end and a delivery end, the spray further comprising a spray cone diverging from the delivery end of the ligament. By "nosepiece end" is meant the point at which a plane (hereinafter the nosepiece plane) drawn perpendicular to the axis of the ligament and just touching the exterior of the nosepiece would intersect the centre of the ligament. The ligament preferably has a length of from about 1 to about 20 mm, more preferably from about 1 to about 10 mm, yet more preferably from about 2 to about 8 mm, and especially from about 3 to about 6 mm from the nosepiece end to the delivery end.

In preferred embodiments the spray cone has a cone angle of from about 10 to about 90°, preferably 20 to about 50°, more preferably from about 30 to about 40°. In electrostatic devices, the length of the ligament and the spray cone angle can be adjusted by varying the viscosity or surface tension of the fluid, by varying the fluid flow rate or exit velocity, or by changing the valve slit characteristics or valve material properties, or by varying the electrical field strength through applied voltage, potential gradient or by use of a field intensifying electrode.

The total length of the ligament can be, and preferably is, longer than the length from the nosepiece end to the delivery end since the ligament preferably originates from a point on the device side of the nosepiece plane, such as from an elastomeric, self-sealing valve as disclosed herein, and passes through a passage in the nosepiece. Suitably the distance from the point of origin of the ligament to the nosepiece plane is in the range from about 2 mm to about 15 mm, preferably from about 3 to about 10 mm and more preferably from about 5 to about 9 mm. In this way the nosepiece can be employed as a field intensifier which helps to control the ligament length. For this purpose the nosepiece is preferably a non-conducting material such as a plastic which can be e.g. polypropylene but is preferably a soft thermoplastic elastomer which provides for greater comfort if held against the nose. Elastomers described herein for the self-sealing valve are also suitable for the nosepiece.

Electrostatic devices suitable for ligament mode spraying are described in WO 96/40441, in EP-A-501,725 and in co-pending application PCT/GB97/02746. Preferably the present device is a device according to embodiments of EP-A-501,725 or PCT/GB97/02746 in which a jet is created by mechanical means and an applied high voltage leads to the jet or ligament breaking up into a spray cone. Suitable jet velocities are from about 0.5 to about 8, preferably from about 1 to about 3 $ms^{-1}$.

A suitable high voltage is in the range from about 1 kV up to about 15 kV, preferably from about 2 kV to about 10 kV and more preferably from about 2 kV to about 5 kV. The voltage can conveniently be applied, even within the constraints of a small hand-held device, from a low voltage (1.5V is sufficient) battery coupled to a step-up transformer. The battery is preferably of the long-life type and can be rechargeable. The generator can be activated by the user by means of an external switch which can also be used to mechanically prime the pump. Preferably the switch includes a metal portion by means of which the user completes an earth return path to the high voltage circuit. A suitable arrangement for the overall device construction is described in PCT/GB97/02746. In this way the user does not acquire a net charge. Alternate arrangements, whereby an alternating voltage is applied, can also be used to prevent charge build-up.

The device is preferably activated to deliver the spray. The ligament of the spray extends through the nostril opening, into the vestibule and preferably to within a short distance of the nasal valve opening, before breaking up to form the spray cone.

In order to provide clean cut-off at low unit volumes the device preferably comprises an elastomeric, self-sealing exit valve having a fluid side and a delivery side, the valve opening to allow passage of the fluid when pressure is applied to fluid on the fluid side and sealing when the pressure is removed. Preferably, clean stop is achieved by having the piston ending its forward movement in a pressure relief chamber (wider diameter area) resulting in a immediate pressure drop and resulting valve closure. By "exit valve" is meant that the elastomeric valve is the final dispensing valve and that there are no other elements of the device which mechanically, restrict or modify the flow of the fluid on the downstream side of the valve. In highly preferred embodiments herein the valve is a slit valve. The valve can comprise a single slit or tow or more intersecting slits, to form a cross shape for example. Preferably, however, the valve comprises a single slit. Although the valve can be flat it is preferably dome-shaped by which is meant a non-planar valve having a recess such as with a hemispherical or frustoconical dome. In preferred embodiments the valve is essentially in the form of a hemispherical dome having a flange along its perimeter so that a collar can be fitted to retain the valve in the device. The diameter of the valve, including the flange, is typically from about 2 to about 6 mm with the dome portion having a diameter of from about 1 to about 4 mm, typically about 2.5 mm and a thickness from inside to out of from about 0.5 to about 1.5 mm, suitably about 1 mm. The valve need not be of uniform thickness. In preferred embodiments the valve dome's exterior surface is hemispherical whereas the internal surface is formed with a small flat at the top of the dome where the slit is formed. Suitable slit widths are from about 50 to about 400 $\mu$m, preferably from about 150 to about 250 $\mu$m. It is to be understood that the slit width refers to the longest dimension of the slit when first created. The term "elastomer" herein refers to a material which is both elastically compressible and elastically extensible. A wide range of elastomers can be used, including but not limited to polyurethanes; chloroprene, butyl, butadiene and styrene-butadiene rubbers, and silicone elastomers such as 2 part room temperature vulcanising (RTV) silicones. Preferred for use herein are the 2 part silicone RTVs. Suitable silicone RTVs are available under the trademark NuSil and have a hardness of from about 30 to about 80 Shore A, preferably from about 40 to about 70 Shore A. The elastomers can optionally be mixed with a suitable plasticiser or foaming agent to make them more compressible. The elastomer may also have other materials dispersed within it in order to modify its properties, such as its conductivity. If elastomers of low tear strength are employed, the slit width may grow if the slit is held open for a prolonged period of time. The slit valve can be formed by piercing an injection or compression moulded elastomeric seal, of the same dimensions and shape as the intended valve, with a pin having a sharpened tip. The slit width is roughly proportional to the pin width. The pin can be a flat blade or can have a polygonal or round cross-section. The pin preferably has a polygonal or, especially, a round cross-section. It has been found that cone-shaped sharp-edged pins create a cut which behaves in use as a flap rather than a hole. This can lead to a jet which is not straight or even to the creation of two or more jets which may lead to unreliable or unpredictable spraying. Suitable pin diameters are from about 100 to 350, more preferably from 150 to 250 $\mu$m in diameter. When silicone elastomers are used it is preferred that the piercing pin is withdrawn rapidly after forming the slit to avoid undesired slit growth. It has further been found that the geometry of the elastomeric seal and the method of piercing have a significant effect on the effectiveness and reproducibility of slit formation. More reliable slit formation is obtained if the seal is pierced from the inside of the dome rather than from the outside.

The valve normally opens when pressure is applied to fluid on the fluid side and seals when the pressure is removed. The applied pressure is suitably in the range from about 200 to about 5000 mbar (20 to 500 kPa), preferably from about 500 to about 3000 mbar (50 to 300 kPa). The flow rate through the valve is generally proportional to the pressure applied and is suitably in the range from about 5 to about 50, more preferably from about 5 to about 30 $\mu ls^{-1}$. At such pressures and with the disclosed valve type and slit dimensions a straight fluid ligament with an exit velocity of from about 0.5 to about 8 preferably from about 1 to about 3 $ms^{-1}$ is obtained.

The diameter of the issuing ligament is partly determined by the flow rate and is generally less than the width of the slit valve. Depending on the flow rate, ligament diameters of less than 50 $\mu$m can be achieved, even when a valve slit width of 200 $\mu$m is employed. The ligament diameter strongly influences the particle size of the spray after break-up into the spray cone, the particle size being broadly similar to the ligament diameter. It is a feature of the ligament mode electrostatic spraying herein that a tightly distributed, almost mono-disperse spray is obtained. It is thus possible to achieve a spray with a median droplet size of from 20 to about 80, preferably from about 30 to about 70 $\mu$m, more preferably from about 40 to about 60 $\mu$m, the particle size distribution generally having a standard deviation of less than 5, typically less than 2 $\mu$m, and preferably less than 1 $\mu$m. It is commonly understood that, for nasal spraying, a particle size of 10 $\mu$m or less is undesirable so that the particles are not carried through into the lungs. It is believed, however, that having an electrostatic charge on the spray particles makes them much less likely to be carried beyond the nose since the charged particles tend to find an earthed surface rather quickly.

The clean stop performance of the tip valve can be further improved by introducing a pressure relief feature behind the valve. This area will provide a sudden pressure drop when the piston enters this area near completing its forward stroke and enforce immediate and secure closure of the valve with no dripping at the end of the full dose.

Methods

The spray device herein is suitable for spraying into a body cavity, particularly into the nose, mouth or ears of a human. The low volume and gentle spray also make it suitable for e.g. ophthalmic spraying. Preferably the device is a nasal spray device. A preferred method of administering a fluid to the nasal cavity from the spray device comprises spraying the fluid into the nasal cavity without substantial penetration of the device into the nostrils. By "without substantial penetration into the nostrils" herein is meant that there is no insertion of a nozzle or such-like into the nasal vestibule. In use, the nosepiece of the device is preferably placed in contact with the nostril opening to obtain the full benefit of the field intensifying effect described herein in relation to the nosepiece. If pressure is applied by the user, for certainly of contact or to assist in orientation there may be some flaring of the nostril or overlap with the septum cartilage but nevertheless the nosepiece will not be completely surrounded by the nostril.

What is claimed is:

1. A dispensing device (1, 2) for a fluid (10), the dispensing device (1, 2) comprising a reservoir (11), a shaft (12), a back seal (13), a damper (14), a piston (151, 152) and a one-way valve (16), the back seal (13) sealing a first end of the reservoir (11) and being displaceable along the shaft (12), the valve (16) being on the second end of the reservoir (11), the piston (151, 152) being fixed to one end of the shaft (12), the piston (151, 152) being located between the valve (16) and the damper, the damper (14) being also fixed to the shaft (12), the damper (14) being located between the piston and the back seal (13), whereby the piston (151, 152) has an opened position (151) and a closed position (152), the open position allowing fluid communication between the valve (16) and the part of the reservoir (11) between the piston (151, 152) and the back seal (13), the displacement of the piston (151, 152) between the opened and the closed position being induced by a displacement of the shaft (12) along its own axis, the pressure in the area comprised between the valve (16) and the piston (151, 152) reducing when the piston is moved from its closed position towards its opened position, the damper (14) collapsing when the piston is moved from its closed position towards its opened position, the only fluid flow from the part of the reservoir (11) situated between the damper (14) and the back seal (13) and the part of the reservoir (11) situated on the other side of the damper (14) being a connecting passage (140) situated in the damper (14) when the piston (151, 152) is moved from its opened position towards its closed position.

2. A dispensing device as in claim 1, whereby the shaft (12) is made out of a material conducting electricity.

3. A dispensing device as in claim 2, whereby the fluid is electrically charged by the shaft (12) prior to being dispensed.

4. A dispensing device as in claim 1, whereby the volume comprised between the piston in the opened position and the valve (16) is of less than 100 $\mu$L.

5. A dispensing device according to claim 1, whereby the volume of fluid dispensed at each dispensing operation varies of less than 10% between each dispensing operation.

6. A dispensing device as in claim 1, whereby the one-way valve (16) is a self-seal valve (16).

7. A dispensing device as in claim 1, whereby the connecting passage (140) is a single opening provided in the damper (14).

* * * * *